US012728496B2

(12) United States Patent
Kley et al.

(10) Patent No.: US 12,728,496 B2
(45) Date of Patent: Sep. 8, 2026

(54) VIBRATION POLISHING DEVICE

(71) Applicant: ATM Qness GmbH, Mammelzen (DE)

(72) Inventors: Michael Kley, Birnbach (DE); Matthias Höfer, Katzwinkel (DE)

(73) Assignee: ATM Qness GmbH, Mammelzen (DE)

( * ) Notice: Subject to any disclaimer, the term of this patent is extended or adjusted under 35 U.S.C. 154(b) by 0 days.

(21) Appl. No.: 18/417,743

(22) Filed: Jan. 19, 2024

(65) Prior Publication Data

US 2024/0157501 A1 May 16, 2024

Related U.S. Application Data

(63) Continuation of application No. 16/330,436, filed as application No. PCT/EP2017/072198 on Sep. 5, 2017, now Pat. No. 11,926,014.

(30) Foreign Application Priority Data

Sep. 6, 2016 (DE) ..... 102016116675.8

(51) Int. Cl.
*B24B 31/06* (2006.01)
*B24B 31/073* (2006.01)
(Continued)

(52) U.S. Cl.
CPC ..... *B24B 31/062* (2013.01); *B24B 31/06* (2013.01); *B24B 31/073* (2013.01); *B24B 31/12* (2013.01); *B24B 49/10* (2013.01); *B24B 49/16* (2013.01)

(58) Field of Classification Search
CPC ..... B24B 49/16; B24B 49/10; B24B 31/12; B24B 31/073; B24B 31/06; B24B 31/062
(Continued)

(56) References Cited

U.S. PATENT DOCUMENTS 3,137,977 A * 6/1964 Graves ..... B24B 37/102 451/28
3,466,815 A 9/1969 Balz
(Continued)

FOREIGN PATENT DOCUMENTS

CH 337089 A * 3/1959 ..... B24B 37/102
CN 104690634 A 6/2015
(Continued)

OTHER PUBLICATIONS

Partial PCT Search Report for PCT Application No. PCT/EP2017/072198 dated Nov. 21, 2017 (11 pages).
(Continued)

*Primary Examiner* — Katina N. Henson
(74) *Attorney, Agent, or Firm* — Reising Ethington P.C.

(57) ABSTRACT

The present disclosure relates to a vibration polishing device, comprising:

a vibration drive for generating an oscillating vibration for polishing samples;

a polishing disc which is connected to and can be driven by the vibration drive; and a polishing bowl which is designed to receive a polishing medium and the samples to be polished and is coupled to the polishing disc;

wherein the coupling between the polishing bowl and the polishing disc is accomplished by a quick-type coupling for transferring the oscillating vibrations from the polishing disc to the polishing bowl when the vibration polishing device is in operation and thereby to move the sample to be polished in the polishing bowl.

22 Claims, 10 Drawing Sheets

(51) Int. Cl.
*B24B 31/12* (2006.01)
*B24B 49/10* (2006.01)
*B24B 49/16* (2006.01)

(58) Field of Classification Search
USPC ..... 451/159, 32, 35, 113
See application file for complete search history.

(56) References Cited

U.S. PATENT DOCUMENTS

| | | | | |
|---|---|---|---|---|
| 3,552,593 | A | 1/1971 | Szopo | |
| 3,978,622 | A | 9/1976 | Mazur et al. | |
| 4,916,865 | A | 4/1990 | Despain et al. | |
| 4,991,360 | A | 2/1991 | Despain | |
| 5,109,633 | A | 5/1992 | Durnil | |
| 5,662,516 | A | 9/1997 | You | |
| 7,143,891 | B2 | 12/2006 | Kumeth | |
| 7,299,913 | B2 | 11/2007 | Kumeth | |
| 2003/0172594 | A1* | 9/2003 | Castro | C04B 35/6262 451/36 |
| 2006/0016667 | A1 | 1/2006 | Kumeth | |
| 2015/0251291 | A1* | 9/2015 | Hovik | B24B 31/06 451/113 |
| 2015/0315696 | A1* | 11/2015 | Stuber | C22B 11/04 75/744 |

FOREIGN PATENT DOCUMENTS

| | | | | |
|---|---|---|---|---|
| DE | 1171303 | B | 5/1964 | |
| DE | 102004034481 | A1 | 2/2006 | |
| DE | 102009044234 | A1 * | 5/2011 | B23Q 3/061 |
| EP | 2364812 | A1 * | 9/2011 | B23Q 3/08 |
| EP | 2638992 | A1 | 9/2013 | |
| GB | 1018759 | A | 2/1966 | |
| JP | S4814689 | Y1 | 4/1973 | |
| JP | S58202764 | A | 11/1983 | |
| JP | 5123997 | B2 | 1/2013 | |
| WO | WO2006061612 | A1 | 6/2006 | |
| WO | WO2012052873 | A2 | 4/2012 | |

OTHER PUBLICATIONS

Partial PCT Search Report for PCT Application No. PCT/EP2017/072199 dated Nov. 27, 2017 (12 pages).
PCT Search Report and Written Opinion for PCT Application No. PCT/EP2017/072199 dated Apr. 9, 2018 (21 pages).
PCT Search Report and Written Opinion for PCT Application No. PCT/EP2017/072198 dated Apr. 11, 2018 (23 pages).
English translation of the International Preliminary Report on Patentability for PCT/EP2017/072198 dated Mar. 21, 2019, (10 pages).
English translation of the International Preliminary Report on Patentability for PCT/EP2017/072199 dated Mar. 21, 2019, (11 pages).
JP Office Action for JP Application No. 2019-533681 dated Mar. 4, 2020 (9 pages).
JP Office Action for JP Application No. 2019-533682 dated Mar. 4, 2020 (8 pages).
Chinese Search Report for CN Application No. 201780054198.3 dated Jun. 30, 2020 (2 pages).

* cited by examiner

VIBRATION POLISHING DEVICE

REFERENCE TO CO-PENDING APPLICATIONS

This application is a continuation of U.S. patent application Ser. No. 16/330,436 filed Mar. 5, 2019, which is a national phase of PCT/EP2017/072198 filed Sep. 5, 2017 and claims the priority of German patent application No. DE102016116675.8, filed on Sep. 6, 2016. The entire contents of these priority applications are incorporated herein by reference.

TECHNICAL FIELD

The present disclosure relates to a vibration polishing device comprising a vibration drive for generating an oscillating vibration in an orbital motion for displacing samples to be polished, a polishing disc which is firmly connected to and can be driven by the vibration drive, and a polishing bowl which is designed to receive a polishing medium and the samples to be polished and which is coupled to the polishing disc for being entrained therewith.

BACKGROUND AND GENERAL DESCRIPTION

Such a vibration polishing apparatus has become known from U.S. Pat. No. 3,137,977 and comprises a revolving motor which drives eccentric weights and thereby causes vibration of the casing thereof. The casing is connected to a drive plate which is permanently connected, through rubber-elastic elements, to a bowl-like component which is supported on a table top or the like, through a base housing. A vibratible platen is integrated in the apparatus in a per se not disassemblable manner and can be frictionally locked to the drive plate by a knob, to follow the vibrations thereof. The vibratible platen is provided with a polishing means or polishing cloth and has an annular rim so that it can be considered as a polishing bowl. The samples to be polished are placed in the polishing bowl using a sample holder and, as a result of the vibrations caused by the imbalance drive, undergo an orbital movement during operation and at the same time a rotational movement. However, such an imbalance drive emits strong detrimental vibrations to the supporting environment of the vibration polishing apparatus. Furthermore, a replacement of the polishing platen which forms a polishing bowl is only possible through cumbersome and time-consuming disassembly of the apparatus The present disclosure provides a vibration polishing device which comprises a polishing bowl designed to receive a polishing medium and the samples to be polished, which is configured so that the polishing bowl can be easily removed from the vibration polishing device and can be simply replaced by another polishing bowl, optionally with a different polishing medium.

A further aspect of the present disclosure includes to provide a vibration polishing device which emits less strong vibrations to the environment than is the case in the prior art.

Another aspect of the present disclosure relates to the sealing attachment of the polishing medium in the polishing bowl, in particular when the polishing medium comprises a polishing cloth and polishing agent suspension.

In accordance with the present disclosure, the subject matter is provided in the independent claims. Refinements of the present disclosure are defined in the dependent claims.

Specifically, a vibration drive is provided for generating an oscillating vibration for an orbital motion of samples to be polished, and the vibration drive, as a unit, drives an additional polishing disc to which it is firmly connected. A polishing bowl is placed on the polishing disc and coupled thereto for being entrained therewith. The polishing bowl is designed to receive a polishing medium and the samples to be polished. As usual, the samples to be polished may be accommodated in sample holders. The coupling, in particular the vertical or axial coupling of the polishing disc and the polishing bowl is accomplished by a quick-type coupling which allows the polishing bowl to be released and replaced quickly, and this may be a mechanical holder, such as a bayonet catch, or may be of magnetic type.

For providing the quick-type coupling, ferromagnetic parts, in particular ferromagnetic layers, are preferred, which cause magnetic adhesion of the polishing bowl to the polishing disc. In other words, the first and second ferromagnetic parts which are in particular provided in the form of first and second ferromagnetic layers cause magnetic adhesion of the polishing bowl to the vibration drive, in particular to the polishing disc, for transferring the oscillating vibrations of the polishing disc to the polishing bowl when the vibration polishing device is in the operation, and thereby to move the samples to be polished in the polishing bowl. This provides for a synergy of safe attachment of the polishing bowl, good transfer of the vibratory movement, and still easy replaceability and good handling.

Preferably, form-fitting engagement portions are furthermore provided, which cause centering and/or horizontal or lateral positively fitting coupling of the polishing bowl to the polishing disc and thus contribute to the entrainment of the polishing bowl in the oscillatory vibration movement of the polishing disc.

In other words, the magnetic adhesion force is dimensioned to achieve, in particular in cooperation with the horizontally or laterally positively fitting form-fitting engagement portions, a three-dimensional coupling of the polishing bowl to the polishing disc, which on the one hand is strong enough to attach the polishing bowl to the polishing disc so that the oscillatory vibration movements of the polishing disc can be transferred to the polishing bowl, and on the other hand can be detached by the user, in particular manually, by overcoming the magnetic adhesion force, for easily replacing the polishing bowl.

The oscillating vibration preferably results in an intermittent obliquely upward tangential movement of the samples to be polished with respect to sample circulation within the polishing bowl, and so in particular causes the samples to bounce and slide on the polishing medium and to perform an orbital movement within the polishing bowl relative to the polishing medium, resulting in the polishing of the samples on the underside thereof.

As a polishing medium, a polishing cloth and polishing agent in a suspension are preferred. Other polishing media are also useful, for example fine abrasive, or fine abrasive paper and/or polishing paper.

As one of the ferromagnetic layers, a magnetic plate or a magnetic foil may be used, and as the other of the ferromagnetic layers, a metal/sheet steel disc or a magnetic foil disc may be used. In both cases, magnetic adhesion of the polishing bowl to the polishing disc is achieved, and therefore a vertical or axial magnetic attachment of the polishing bowl to the polishing disc, which is preferably easily detachable.

The magnetic plate or magnetic foil may be glued to the upper side of the polishing disc or to the underside of the polishing bowl. The sheet steel disc or magnetic foil disc may be glued to the underside of the polishing bowl or to the upper side of the polishing disc. This is a simple but effective method of attachment.

Head bolts may be used as the first form-fitting engagement portions, and engagement openings may be used as the second form-fitting engaging portions. With the heads of the head bolts engaging in the engagement openings, relative movement between the polishing disc and the polishing bowl is prevented. In other words, the form-fitting engagement portions cause the polishing bowl to be horizontally or laterally fixed on the vibration drive or on the polishing disc, for transferring the oscillating movement of the polishing disc to the polishing bowl. In addition, the laterally positively fitting form-fitting engagement portions may preferably comprise a centering hub in order to achieve centering and indexing of the polishing bowl. In other words, in particular the preferred combination of vertically or axially effective magnetic adhesion and horizontally or laterally effective positive fit achieves a stable, yet easily detachable and practically manageable attachment of the polishing bowl on the vibration drive that is on the polishing disc for transferring the oscillating movement of the vibration drive or polishing disc to the polishing bowl. However, it should not be ruled out that a horizontally or laterally effective positive fit can be dispensed with, for example if the magnetic adhesion force is strong enough to prevent horizontal or lateral displacement, or if other means can be used for horizontally or laterally fixing the polishing bowl on the polishing disc.

It is preferred to make the polishing bowl of a plastic material, with a carrier material for a separately handled polishing agent on the bottom inner surface. The carrier material may be a polishing cloth which in particular adheres magnetically to the polishing bowl. For this purpose, the polishing cloth may be provided with magnetized ferromagnetic means on its underside. The polishing bowl has a circumferential lateral wall with an annular or spline groove which extends above the base wall of the polishing bowl at a height level corresponding to the thickness of the carrier material, and which accommodates a rubber-elastic ring covering the edge of the carrier material in a clamping manner and thus prevents the polishing cloth from becoming loose. The rubber-elastic ring can be easily removed so that the polishing cloth or other carrier material of the polishing agent is easily replaceable.

In accordance with the present disclosure, the polishing bowl is designed as a container for the polishing cloth and polishing agent suspension and can be closed tightly with a lid, and it is equipped with a carrying handle so that it can be placed on the polishing disc or lifted from the polishing disc as a whole. Thus, a plurality of polishing bowls may be made available for a vibration polishing device, which can be easily changed on the polishing device, and which have a specification that is easily recognizable by labelling. The polishing bowls are suitably designed to be stackable. For the polishing work to be performed, different polishing bowls with different grades of granulation of the polishing agent can be used successively, without causing complications in the processing of the samples to be polished. Namely, the samples may be cleaned between the individual processing steps in order to avoid carryover of polishing medium of different granulation between individual containers. Apart from that, the containers are easy to clean.

The vibration polishing device is preferably configured so that an edge gap is provided between the polishing bowl and the polishing disc, into which a tool is engageable to gently lift the polishing bowl from the polishing disc. The lifting tool may be applied in the gap, however, it is likewise possible to provide the lifting tool as part of the vibration polishing device. Such an integrated lifting tool has an engaging portion in the edge gap and a grip portion outside the edge gap and is capable of gradually increasing the edge gap, for example by turning the grip portion thereby causing the polishing bowl to be gently lifted from the polishing disc. In this way, sloshing of polishing agent suspension in the polishing bowl is avoided, when the latter is to be changed.

The vibration drive is favorably configured so that it comprises a vibration plate to which the polishing disc is mounted. A convenient method of mounting is a screw connection in conjunction with the indexing of the polishing disc on the vibration plate of the vibration drive.

In addition to the vibration plate, a preferred vibration drive comprises an annular or disc-shaped base part and an annular or disc-shaped counter-oscillating part, which are coupled by first leaf springs. These first leaf springs extend according to helical surfaces with respect to the central axis of the device and allow for mutually oppositely oscillating rotational oscillatory movements between the base part and the counter-oscillating part.

The vibration plate of the vibration drive is coupled to the base part by second leaf springs which extend according to helical surfaces with respect to the central axis of the device, like the first leaf springs. An electromotive drive is arranged between the counter-oscillating part and the vibration plate and preferably comprises a magnetic coil or a solenoid on the counter-oscillating part and a magnetic armature on the vibration plate to produce oppositely oscillating rotational oscillatory movements between this counter-oscillating part and the vibration plate, by switching on and off the solenoid, so that the magnetic armature tensions or relaxes the second leaf springs. In this case, the vibration plate lifts off a little from the counter-oscillating part when the leaf springs are tensioned by the drive, and when the drive is briefly switched off, the vibration plate moves back onto the counter-oscillating part. By periodically switching on and off the drive, it is thus possible to generate a rotational oscillatory movement of the vibration plate relative to the counter-oscillating part about the central axis of the device.

The vibration drive with the base part, the counter-oscillating part, and the vibration plate, which are coupled in pairs by the first and second leaf springs, permit to balance mass forces and thus to balance oscillation forces such that little vibration energy is emitted to the environment, compared to an imbalance drive as in prior art vibration polishing devices.

In the vibration polishing device, the vibration drive, the polishing disc, and the polishing bowl form a first unit which is mounted with vibration damping in a protective housing and is arranged next to a control unit which forms a second unit. The protective housing has an overall wedge-like shape with truncated wedge tip. The control unit of the vibration device is accommodated in the portion of the truncated wedge tip of the protective housing, while the control panel is disposed outside the protective housing. A touchscreen is preferred on the control panel. Overall, a slim vibration device is obtained, in which the polishing bowl is arranged so as to be partially recessed, in particular half countersunk, in the housing.

Vibration polishing devices are commonly used with sample holders into which the samples to be polished are fitted. For the vibration polishing device of the present disclosure, sets of sample holders of different dimensions and weights are provided. The first drive part and the counter-oscillating part oscillate in one direction, and the second drive part with the vibration plate and all the parts connected thereto oscillate in the other direction. Since the inertial masses of the samples, the sample holders, the polishing bowl, the polishing disc, the vibration plate, and of the second drive part of the electromotive drive oscillate against the movement direction of the inertial mass of the counter-oscillating part and of the first drive part of the electromotive drive, an inertial mass compensation occurs, which ideally results in that the center of gravity remains approximately at rest, so that the supporting forces onto the stand of the vibration polishing device remain approximately constant and hardly any vibrations are emitted to the environment. Disturbing forces are balanced out by appropriate control by the control unit of the device.

Thus, extraordinarily smooth running is achieved with the vibration polishing device according to the present disclosure.

BRIEF DESCRIPTION OF THE FIGURES

An exemplary embodiment will now be described with reference to the drawings, wherein.

DETAILED DESCRIPTION

The main parts of the vibration polishing device include a vibration drive 1, a polishing disc 2, and a polishing bowl 3. In addition, the device also comprises a control unit 4 and a protective housing. 5.

Figure 4:
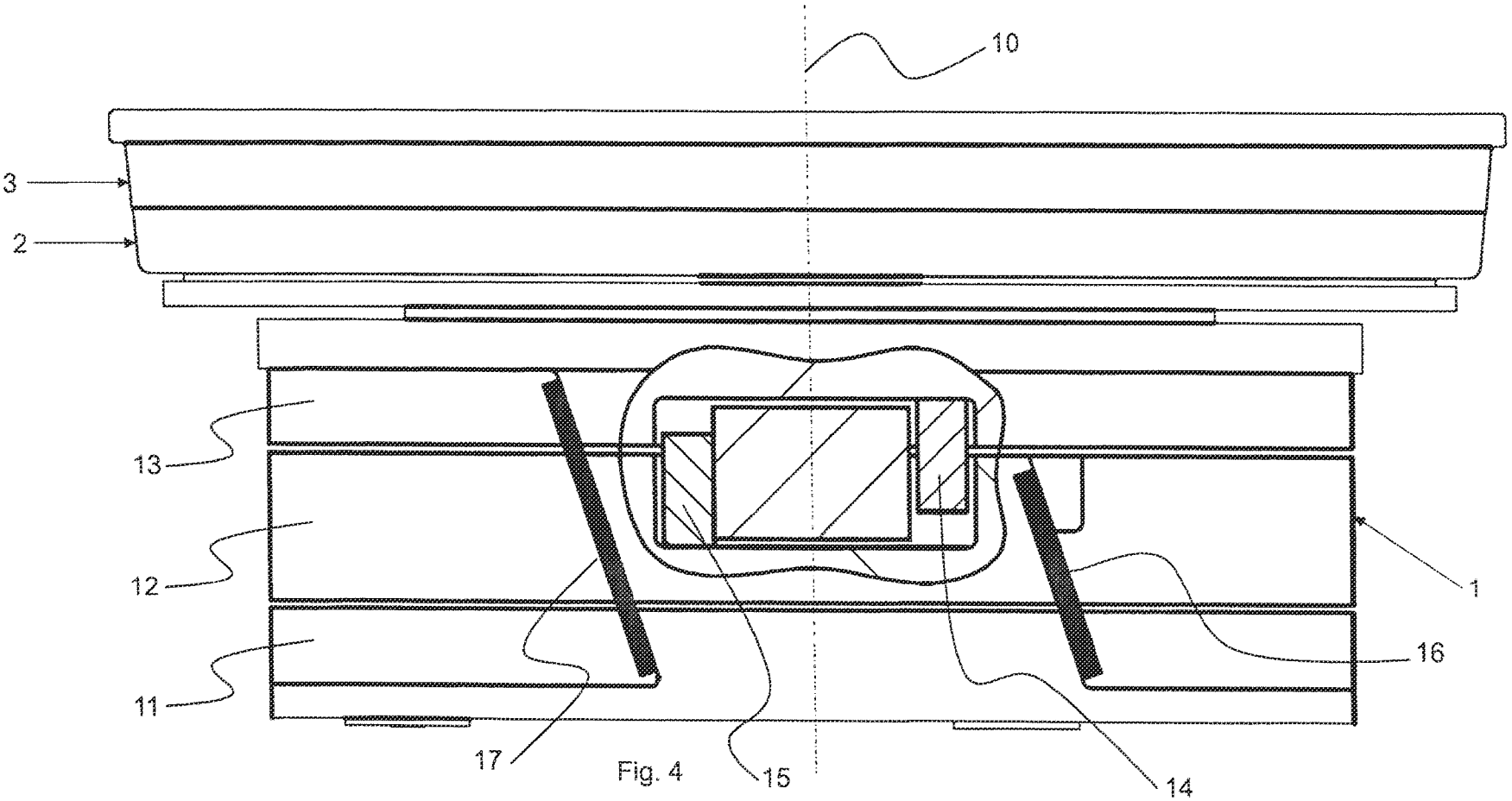
FIG. 4 shows a partially sectional side view of a vibration drive.

The electromotive vibration drive 1 (FIG. 4) comprises an annular or disc-shaped base part 11, an annular or disc-shaped counter-oscillating part 12, a vibration plate 13, and an electromotive drive with a first drive part 14 and a second drive part 15. The base part 11 is coupled to the counter-oscillating part 12 by first leaf springs 16. Furthermore, the base part 11 is coupled to the vibration plate 13 by second leaf springs 17. Each of leaf springs 16 and 17 form three spring packs which are arranged in distributed manner around the circumference of the device. A central axis or axis of symmetry 10 can be associated with the vibration drive 1, and the leaf springs 16 and 17 form very steep helical surfaces relative to this axis, like thread sections of a multi-thread screw, which extend radially to the central axis 10 and at an inclination angle of 18° relative to the central axis 10. The structure of vibration drive 1 has been described in detail in DE 10 2004 034 481 B4 or U.S. Pat. No. 7,143,891 B2, to which reference is hereby made and which are hereby incorporated by reference into the subject matter of the present disclosure.

Figure 1:
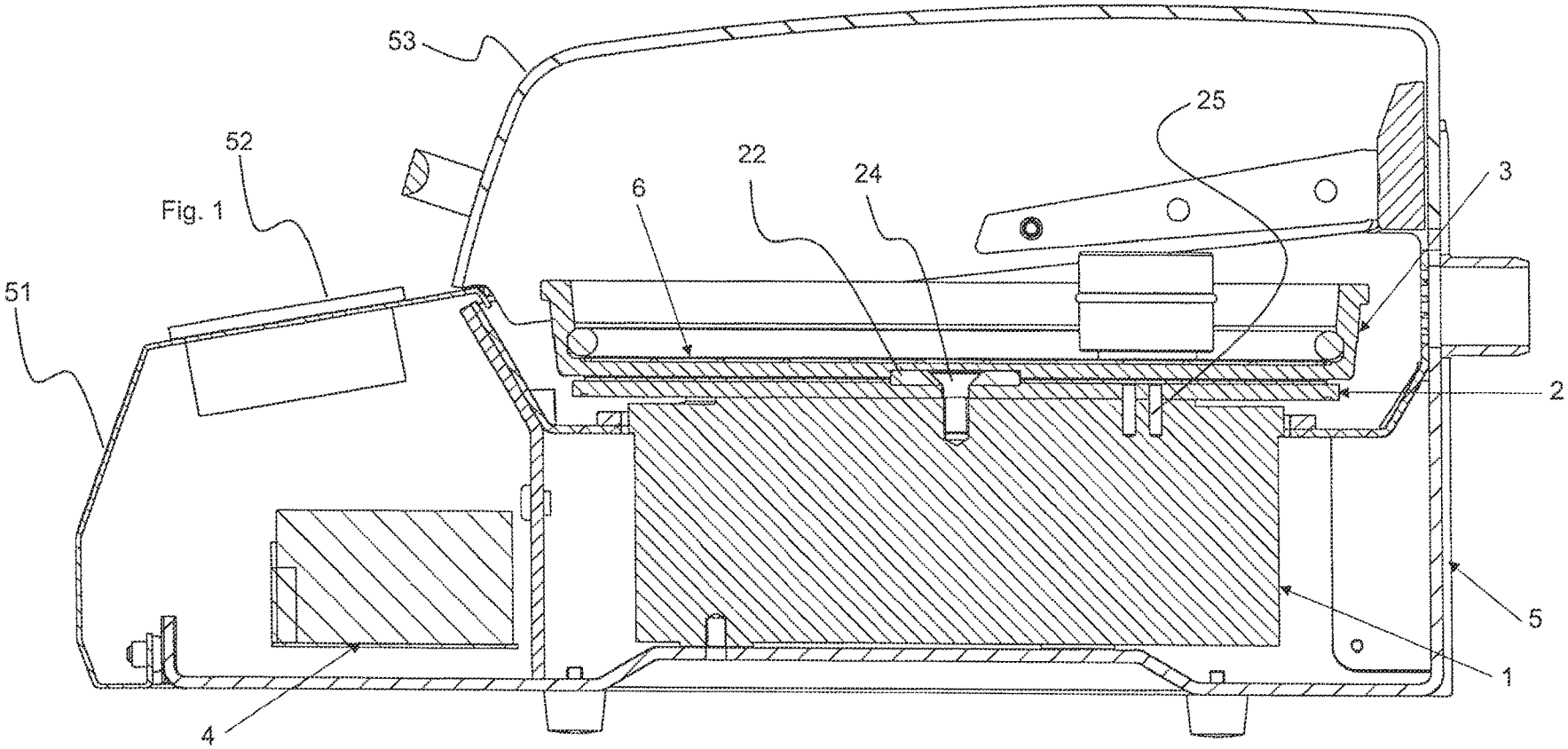
FIG. 1 shows a schematic longitudinal sectional view through a vibration polishing device.
Figure 2:
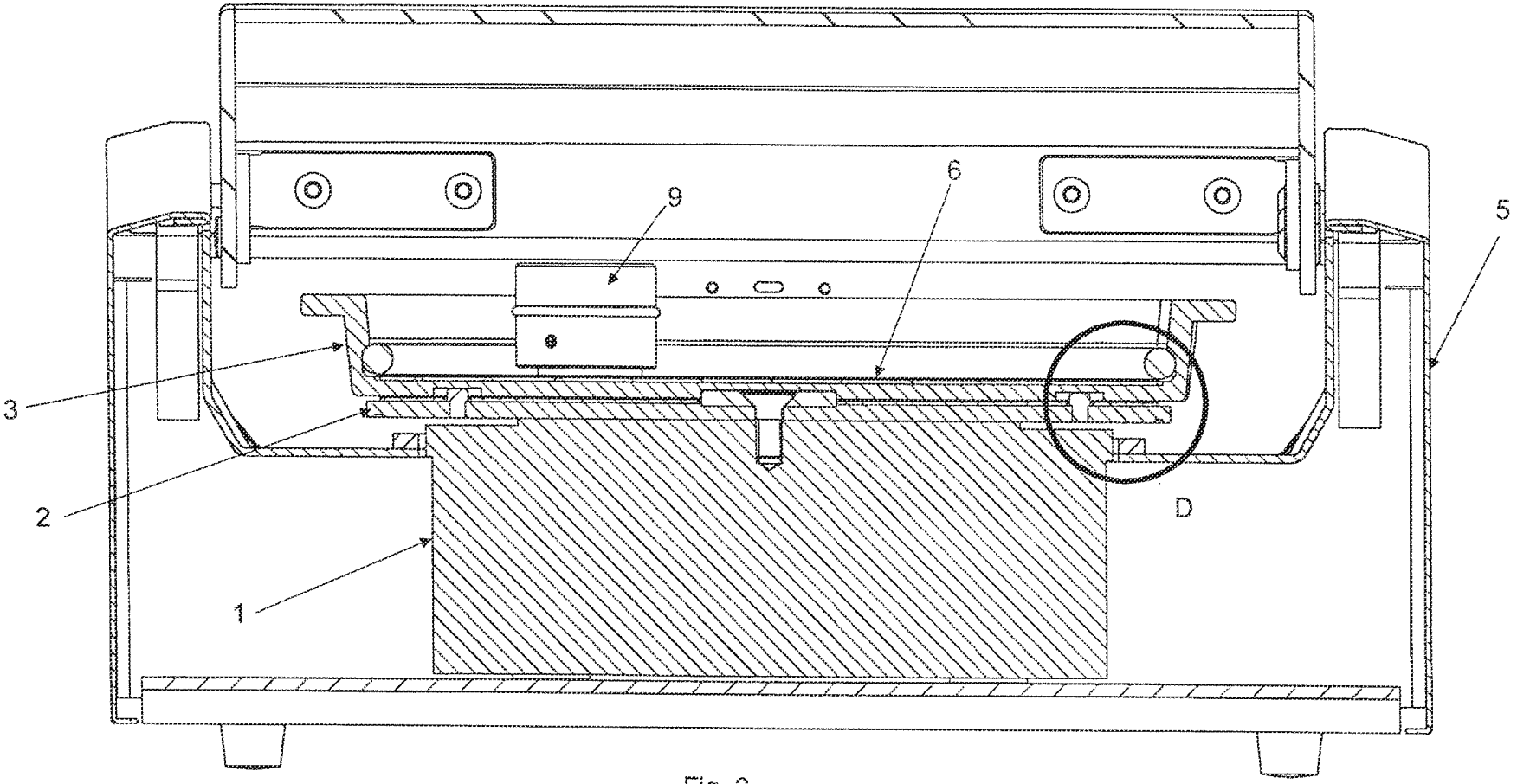
FIG. 2 shows a schematic cross-sectional view through the vibration device.

As shown in FIGS. 1 and 2, the polishing disc 2 is firmly connected to the vibration drive 1, namely by being screwed to the vibration plate 13 at 24 and indexed at 25. On its upper side, the polishing disc 2 has a magnetic plate or a magnetic sheet 21 (FIG. 3), as a first ferromagnetic layer, which is secured on the upper side of the polishing disc 2, in the present example glued thereto. Head bolts 23 which engage in engagement openings 33 of the polishing bowl 3 can be regarded as form-fitting engagement portions of a quick-type coupling.

The polishing bowl 3, preferably made of plastics, is coupled with the polishing disc 2 for being entrained therewith, and for this purpose it has a magnetic foil sheet or sheet steel disc 31 on its underside, as a second ferromagnetic layer, which may be glued to the underside of the polishing bowl 3. When the polishing bowl 3 is placed on the polishing disc 2, the ferromagnetic layers are effective to couple the polishing bowl 3 to the polishing disc 2, whereby the polishing bowl 3 is entrained in the oscillating vibration of the polishing disc 2.

The polishing disc 2 is fixed on the upper side of the vibration plate 13 by a central screw 24 and a centering disc 22 and is indexed by eccentrically arranged indexing pins 25.

The centering disc 22 engages in a central recess 32 in the base wall of polishing bowl 3 in order to center the polishing bowl 3. Likewise, head bolts 23 engage in corresponding base wall recesses 33 of the polishing bowl 3 to provide a positive fit against rotation between the vibration drive 1 or polishing disc 2 relative to the polishing bowl 3.

Figure 5:
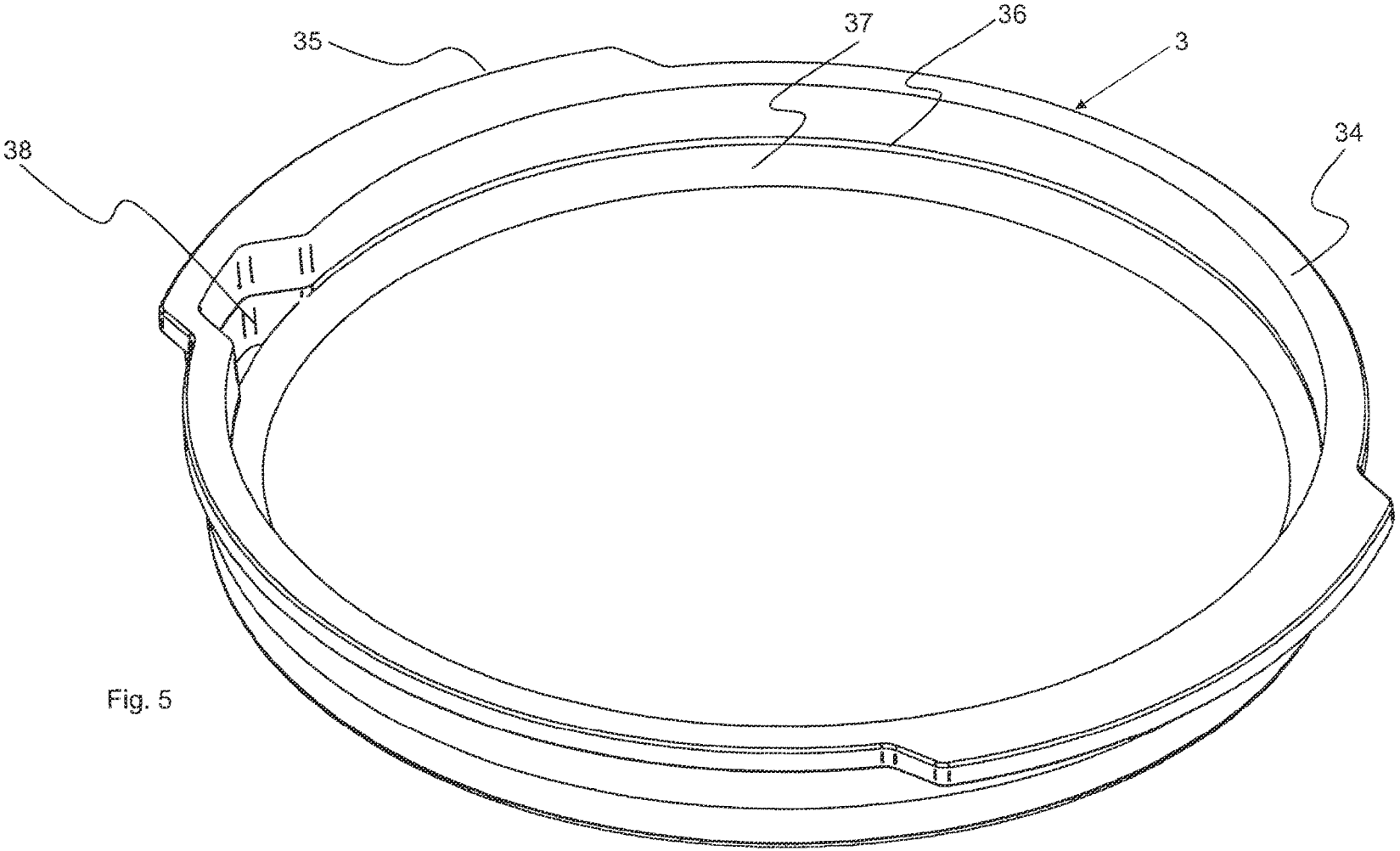
FIG. 5 is a perspective view from above of a polishing bowl.
Figure 6:
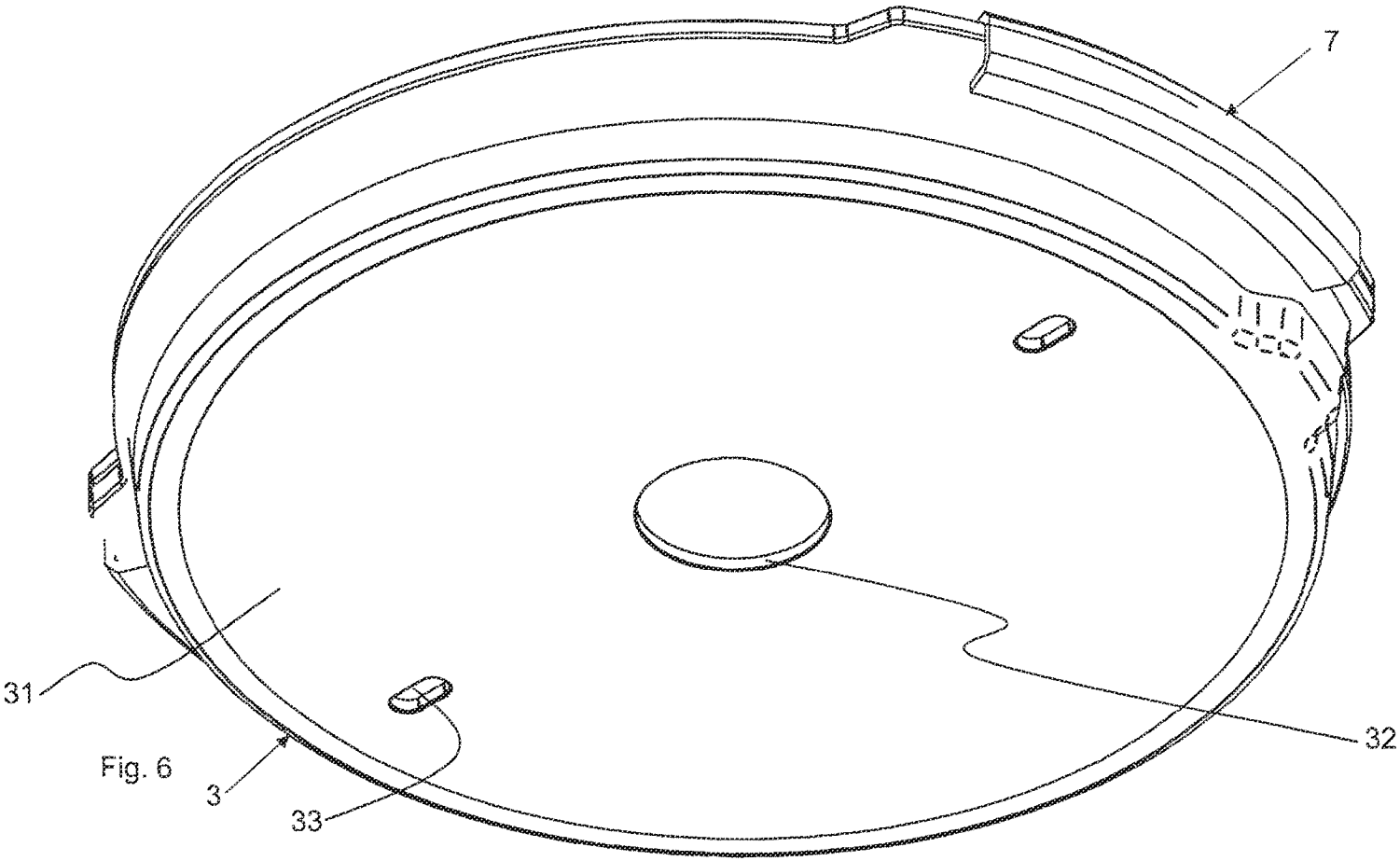
FIG. 6 is a perspective view from below of a polishing bowl.

FIGS. 5 and 6 are perspective views illustrating the polishing bowl 3 and showing the sheet steel disc 31 at the underside of the base wall. The polishing bowl 3 has a lateral wall 34 with carrying handle 35 attached thereto. As can be seen from FIGS. 3 and 5, lateral wall 34 has a circumferential spline groove 36, and a receiving space for a polishing cloth 6 (FIG. 3) is provided therebelow. The edge of polishing cloth 6 is clamped by a rubber-elastic ring 37 which engages in the spline groove 36 thereby holding down the edge of polishing cloth 6. Finger openings 38 on lateral wall 34 help to remove the elastic ring 37 from spline groove 36 and to replace the polishing cloth 6 in this way, the latter being provided with magnetized ferromagnetic means on its underside for good support and adherence. It is preferred for the polishing bowl to be made of a plastic material. Polishing cloth 6 constitutes a carrier material onto which a polishing agent suspension is applied.

Figure 7:
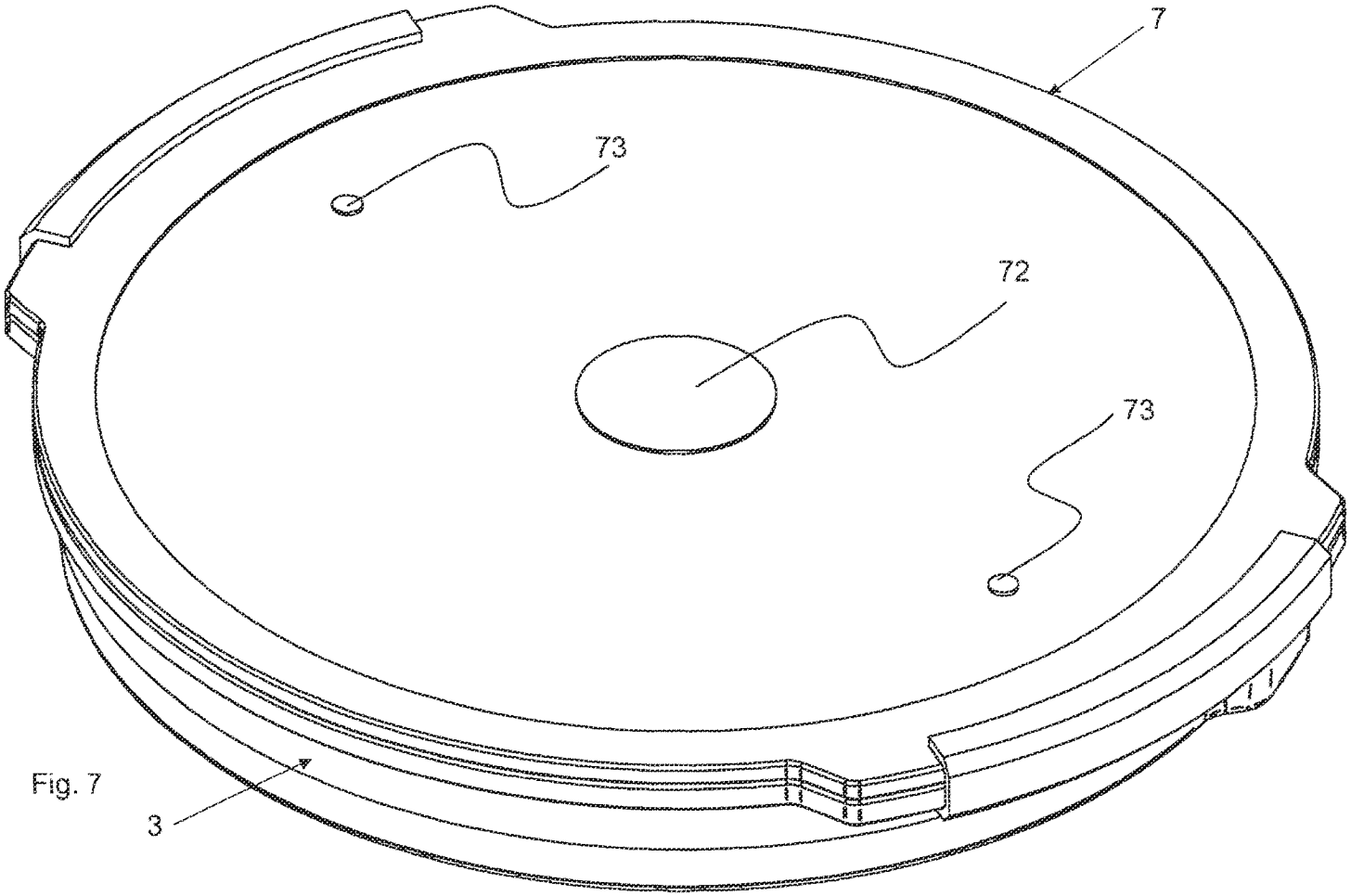
FIG. 7 is a perspective view from above of a lid for the polishing bowl.

The polishing bowl 3 can be closed with a lockable lid 7 (FIGS. 6, 7) so as to form a closable container for the polishing cloth and the polishing agent suspension. Lid 7 has projections 72 and 73 which fit into base wall recesses 32 and 33 of the polishing bowl, so that closed polishing bowls 3 (FIGS. 6, 7) can be stacked one above the other. It is contemplated to provide, together with a vibration polishing device, a plurality of such polishing bowls (FIGS. 6, 7) which may hold polishing agent suspensions of different granulation. In this way, the vibration polishing device can be used first as a fine grinding device for samples to be polished, and subsequently as a final polishing device.

Figure 3:
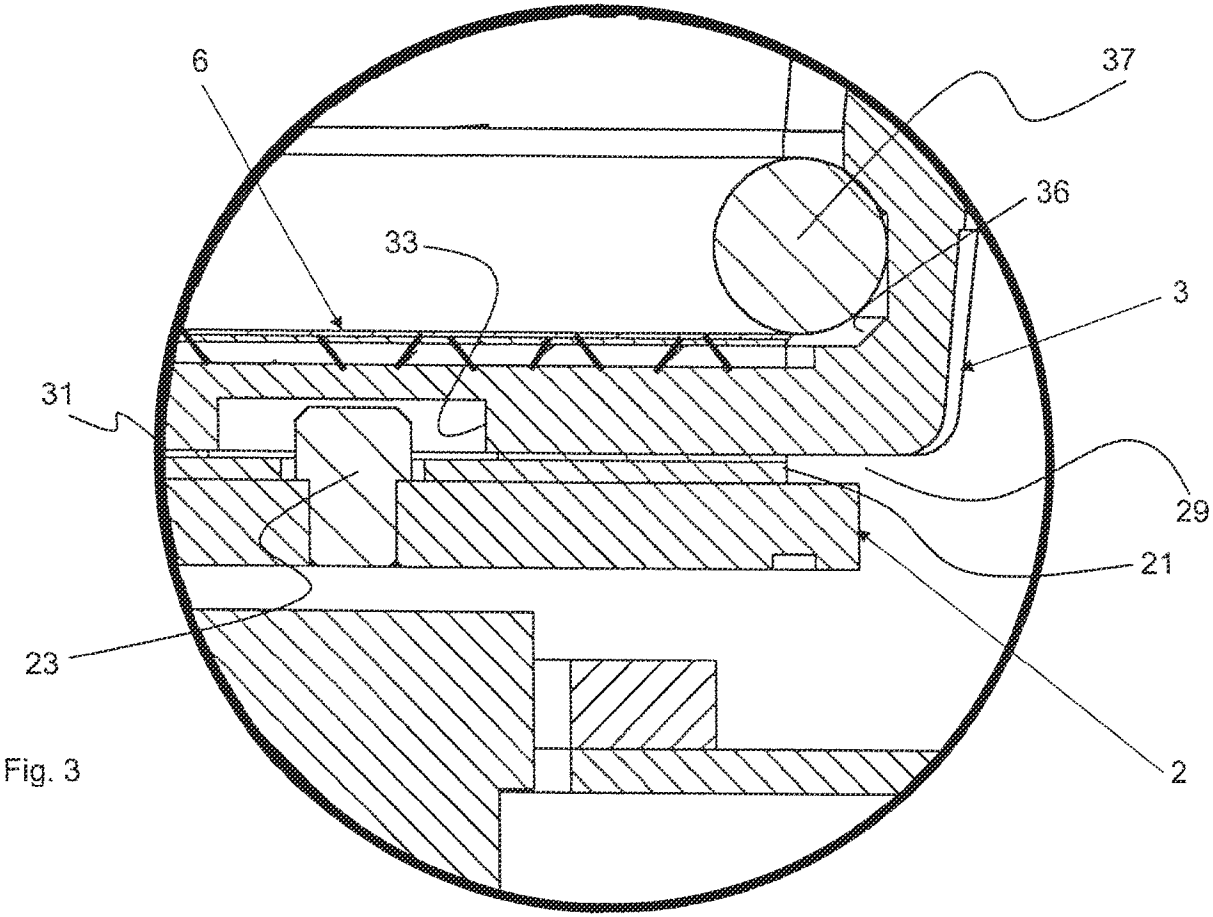
FIG. 3 shows an enlarged detail of FIG. 2.

As can be best seen in FIG. 3, an edge gap 29 is provided between polishing disc 2 and polishing bowl 3, in which a tool can be engaged to gently lift the polishing bowl 3 from the polishing disc 2. The gentle lifting may be mechanized, for example by having a handle with a cam at the front end thereof engaging in the gap 29 (not shown), and the cam widening the gap 29 by turning the tool and thereby gently lifting the polishing bowl 3 from the polishing disc 2, against the magnetic adhesion force. It will also be sufficient to gently lift the polishing bowl by the handles 35.

As can be seen from FIG. 1, the vibration drive 1, the polishing disc 2, and the polishing bowl 3 form a first unit, which is arranged in the protective housing 5 next to the control unit 4 which forms a second unit. The protective housing 5 has an overall wedge-like shape with truncated wedge tip 51 in which the control unit 4 is accommodated. In the section of the truncated wedge tip 51, the upper side of the protective housing 5 is designed as a control panel and may include a touch screen 52. A housing hood 53 serves to cover the vibration polishing device.

Figure 8:
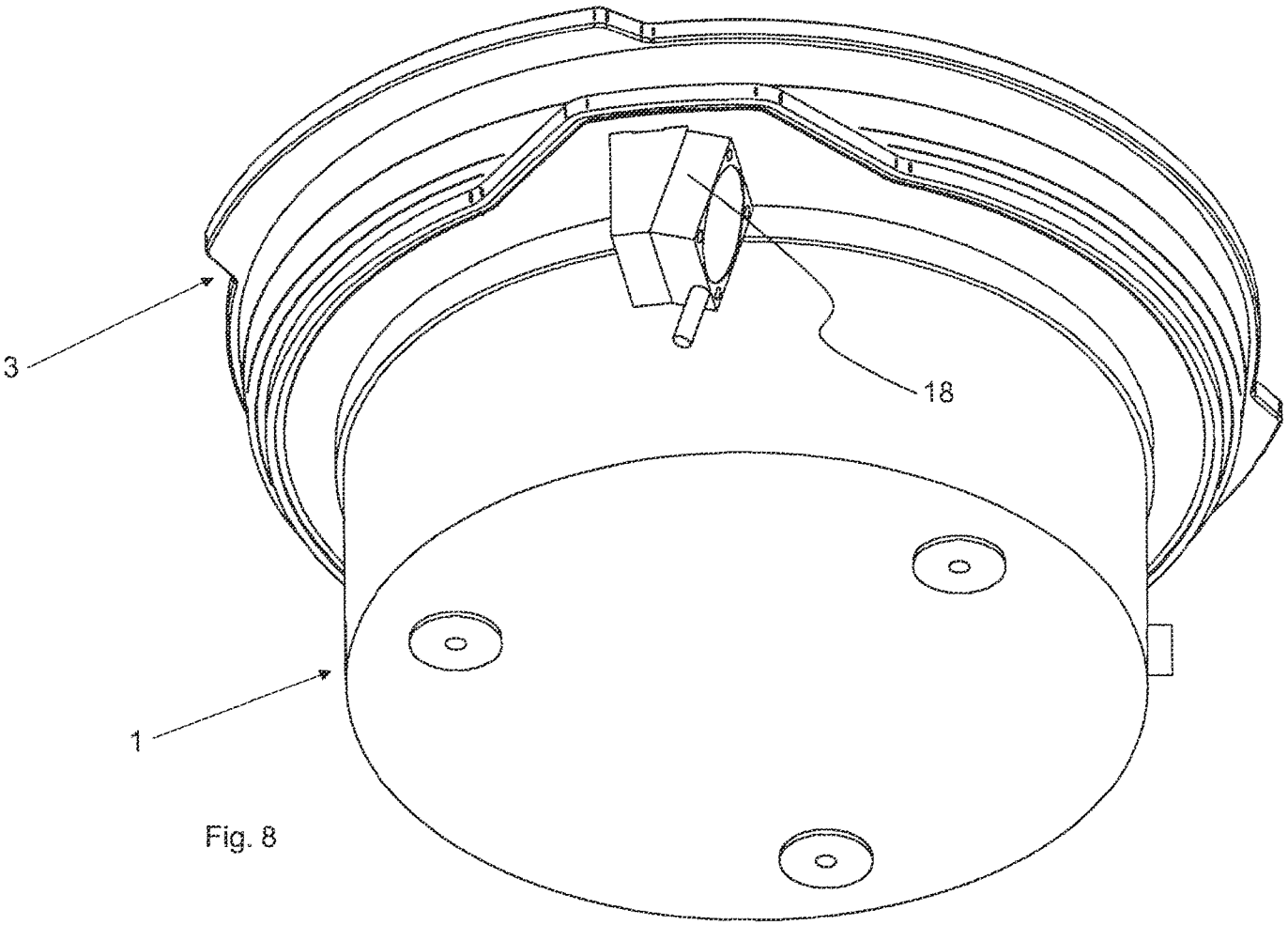
FIG. 8 is a perspective view of a vibration drive from below, with a polishing bowl placed thereon.

FIG. 8 shows the vibration drive 1 with the polishing bowl 3 placed thereon, and with an acceleration sensor 18 that is capable of measuring the accelerations between polishing disc 2 and polishing bowl 3 and of producing acceleration signals therefrom. These signals are fed back to the control unit 4 to control the voltage, current, and pulse output supplied to the vibration drive.

Figure 9:
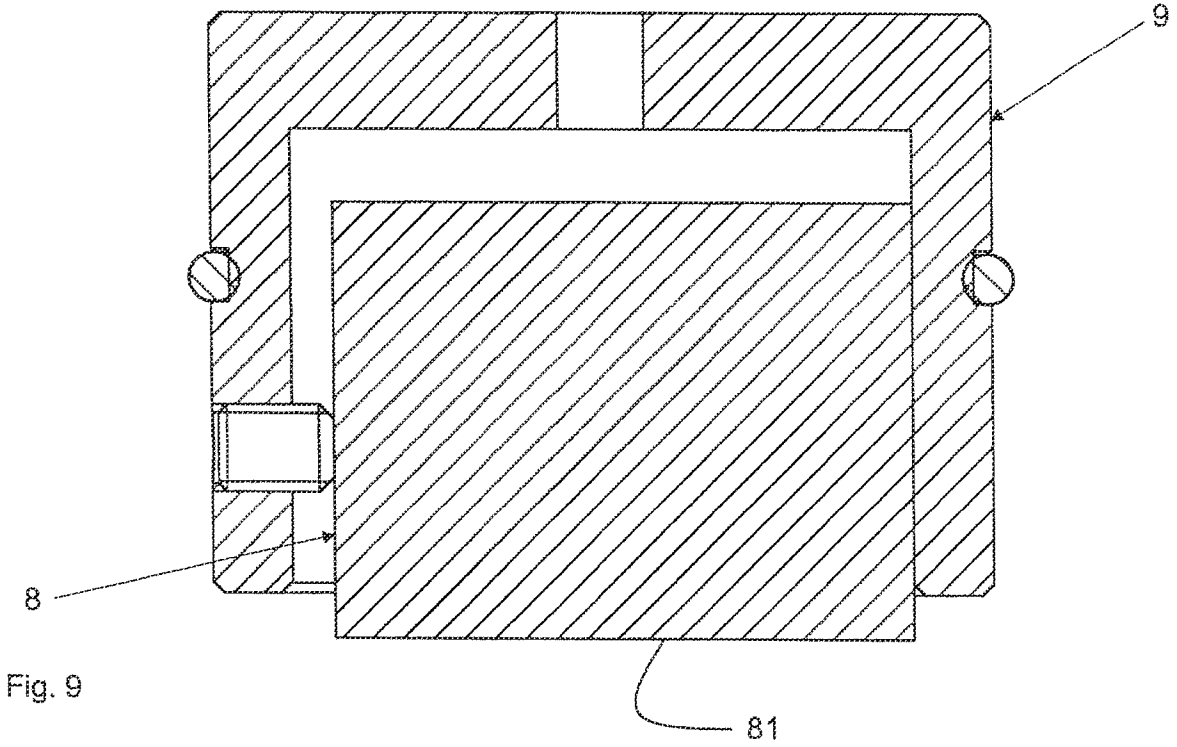
FIG. 9 is a sectional view of a sample holder.
Figure 10:
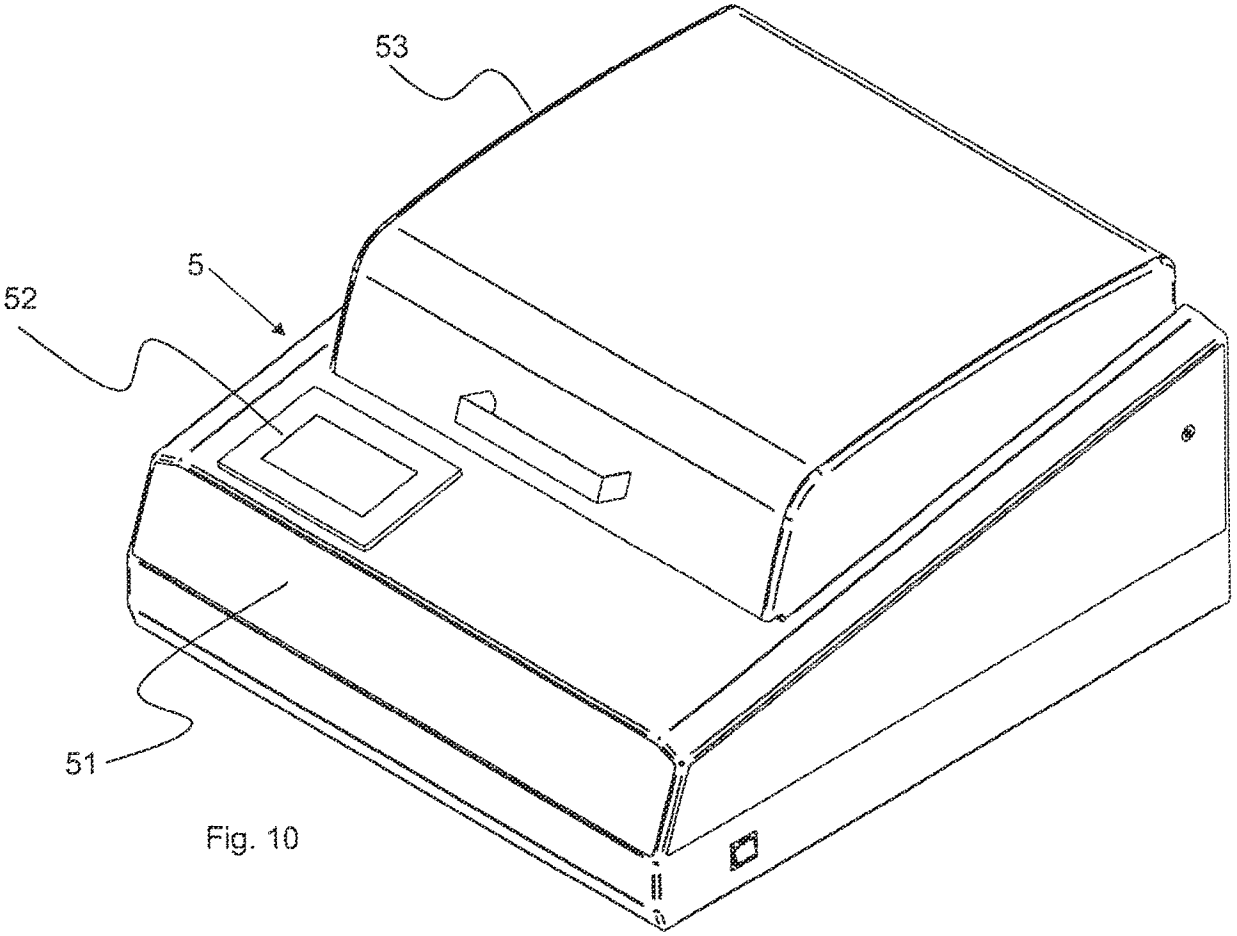
FIG. 10 is an overall perspective view of a vibration polishing device.

FIG. 9 shows a sectional view through a sample 8 and a sample holder, which can be used to appropriately clamp the sample 8 so that it can be placed with its underside 81 on the polishing cloth 6.

The operation of the vibration polishing device is as follows.

First, a plurality of samples 8 to be polished are prepared for the polishing process. In most cases this means that the samples are positioned in the sample holders 9 such that the surface 81 to be polished protrudes from the sample holder.

Control unit 4 is switched on to output electric currents of predetermined frequency and amperage to set the vibration drive 1 in motion. The vibrations generated on the vibration plate 13 are oscillating and cause the samples 8 to be polished and located in the polishing bowl to perform intermittent bouncing movements while being driven circumferentially in the polishing bowl 3. At each voltage surge, the first and second drive parts 14, 15 move relative to each other, and so does the counter-oscillating part 12 relative to the vibration plate 13, whereby the leaf springs 16 and 17 are tensioned, and when the voltage pulse drops the leaf springs 16 and 17 bring the device parts back into their starting position. Polishing disc 2 is firmly connected to the vibration plate 13 and therefore follows the movements thereof. However, this also applies to the polishing bowl 3, since the latter is entrained mechanically and/or magnetically. Indexing pins 25 prevent an unwanted rotational movement of the polishing bowl 3 relative to the polishing disc 2.

The described embodiment is to be considered by way of example. Various modifications are possible. It is well known that movements can be superimposed on each other. It is possible to provide two first drive parts and two second drive parts and to superimpose the movements generated thereby in order to promote the circulation of the samples to be polished in the pot-shaped polishing bowl. An even more favorable result can be achieved with three first and second drive parts.

It will be apparent to a person skilled in the art that the features, whether disclosed in the specification, the claims, the figures, or otherwise, may individually define essential components of the present disclosure, even if they are described together with other features.

The invention claimed is:

1. A vibration polishing device, comprising:

a vibration drive for generating an oscillating vibration for polishing samples;

at least one sample holder configured to hold a sample to be polished;

a polishing disc which is connected to and driven by the vibration drive; and a polishing bowl which is designed to receive a polishing medium and the at least one sample holder with a sample to be polished and is coupled to the polishing disc for being entrained therewith; wherein the polishing bowl is releasably attached to the polishing disc and wherein the releasable attachment is accomplished by magnetic adhesion force; and wherein the polishing bowl has a flat bottom surface having a diameter that is greater than a height of the polishing bowl so that an underside of the sample is polished by relative movement between the flat bottom surface of the polishing bowl and the at least one sample holder; and wherein the polishing medium comprises a polishing cloth as a carrier material for a polishing agent suspension, and wherein the polishing cloth is releasably secured to the flat bottom surface of the polishing bowl.

2. The vibration polishing device of claim 1, wherein the polishing disc has a first ferromagnetic part on its upper side and the polishing bowl is equipped with a second ferromagnetic part on its underside, wherein the first and second ferromagnetic parts cooperate to provide adhesion of the polishing bowl to the polishing disc.

3. The vibration polishing device of claim 2, wherein one of the ferromagnetic parts is a ferromagnetic layer in the form of a magnetic plate or magnetic foil, and the other ferromagnetic part is a ferromagnetic layer in the form of a ferrometal disc or magnetic foil disc.

4. The vibration polishing device of claim 3, wherein the magnetic plate or magnetic foil is glued to the upper side of the polishing disc or to the underside of the polishing bowl.

5. The vibration polishing device of claim 3, wherein the ferrometal disc or magnetic foil disc is glued to the underside of the polishing bowl or to the upper side of the polishing disc.

6. The vibration polishing device of claim 1, comprising centering and indexing means arranged between the polishing disc and the polishing bowl.

7. The vibration polishing device of claim 1, wherein the polishing cloth is magnetically adhered to the polishing bowl.

8. The vibration polishing device of claim 1, wherein the polishing bowl has a base wall with a receiving space for the polishing cloth and a circumferential lateral wall with a spline groove for receiving a rubber-elastic ring to cover and sealingly engage on an edge of the polishing cloth.

9. The vibration polishing device of claim 1, wherein the polishing bowl is in a form of a plastic container for the carrier material and the polishing agent suspension and can be closed with a lid and has a carrying handle for being placed on the polishing disc and lifted from the polishing disc as a whole.

10. The vibration polishing device of claim 1, wherein an edge gap is provided between the polishing bowl and the polishing disc, into which a tool is engageable to gently lift the polishing bowl from the polishing disc.

11. The vibration polishing device of claim 1, wherein the vibration drive comprises a vibration plate to which the polishing disc is mounted and which is capable of executing rotational oscillations around a central axis.

12. The vibration polishing device of claim 11, wherein in addition to the vibration plate, the vibration drive furthermore comprises an annular base part and an annular counter-oscillating part which extend around the central axis and are coupled by first leaf springs that extend according to helical surfaces, so that mutually oppositely oscillating rotational oscillatory movements are possible between the base part and the counter-oscillating part.

13. The vibration polishing device of claim 12, wherein the vibration plate is coupled to the base part by second leaf springs which extend radially and around the central axis according to helical surfaces, and further comprising an electromagnetic drive comprising a first drive part on the counter-oscillating part and a second drive part on the vibration plate for producing, during operation, oppositely oscillating rotational oscillatory movements between the counter-oscillating part and the vibration plate.

14. The vibration polishing device of claim 13, further comprising a control unit controlling the first and second drive parts in opposite directions and for balancing disturbing forces.

15. The vibration polishing device of claim 14, wherein the vibration drive, the polishing disc, and the polishing bowl form a first unit which is arranged in a protective housing next to the control unit which forms a second unit.

16. The vibration polishing device of claim 15, wherein the protective housing has an overall wedge-like shape with a truncated wedge tip which accommodates the control unit that includes a control panel outside the protective housing.

17. The vibration polishing device of claim 1, wherein the polishing cloth has its upper peripheral edge covered by an elastic ring which is clamped in a groove of the polishing bowl.

18. The vibration polishing device of claim 1, wherein the polishing bowl has a lid to provide a closable container which is stackable with further closable containers.

19. The vibration polishing device of claim 18, wherein the polishing bowl has a central recess for centering the polishing bowl on the polishing disc and for cooperating with a central projection of the lid in terms of stackability of polishing bowls.

20. The vibration polishing device of claim 1, further, comprising:

a mechanism for lifting the polishing bowl from the polishing disc.

21. The vibration polishing device of claim 1, comprising:

wherein the magnetic adhesion force on the one hand is strong enough to attach the polishing bowl to the polishing disc so that the oscillatory vibration of the polishing disc can be transferred to the polishing bowl, and on the other hand can be overcome manually by a user.

22. A vibration polishing device, comprising:

a vibration drive for generating an oscillating vibration for polishing samples;

at least one sample holder configured to hold a sample to be polished;

a polishing disc which is connected to and driven by the vibration drive;

a polishing bowl which is designed to receive a polishing medium comprising a polishing cloth and the at least one sample holder with a sample to be polished and is coupled to the polishing disc for being entrained therewith, wherein the polishing bowl is releasably attached to the polishing disc and wherein the releasable attachment is accomplished by a magnetic adhesion force; and wherein the polishing bowl has a planar bottom surface, said planar bottom surface receiving the at least one sample holder with a sample with its underside thereon, and wherein the oscillating vibration is configured to cause the at least one sample holder to slide on the planar bottom surface and on the polishing cloth, which is releasably secured to the planar bottom surface within the polishing bowl, resulting in polishing of the sample on its underside.

* * * * *